United States Patent [19]

Dickie

[11] Patent Number: 4,960,392

[45] Date of Patent: Oct. 2, 1990

[54] SHIELDED CONNECTOR ASSEMBLY WITH NOISE SUPPRESSOR

[76] Inventor: Robert G. Dickie, 15 Valley Trail, R.R. #1, Newmarket, Ontario, Canada, L3Y4V8

[21] Appl. No.: 465,700

[22] Filed: Jan. 16, 1990

[51] Int. Cl.[5] ..... H01R 13/66

[52] U.S. Cl. ..... 439/620; 439/610; 336/84 C; 336/175; 333/185

[58] Field of Search ..... 439/610, 620, 98, 99; 333/181–185; 336/84 C, 84 R, 175, 176

[56] References Cited

U.S. PATENT DOCUMENTS 3,614,694 10/1971 Koontz ..... 336/175

4,818,957 4/1989 Cort ..... 333/181

*Primary Examiner*—Gary F. Paumen

*Attorney, Agent, or Firm*—Robert O. Nimtz

[57] ABSTRACT

A multiconductor shielded connector is disclosed in which a flexible, compressible double bushing is used between the connector half shells and the multiconductor cable. The double bushing comprises an outer bushing dimensioned to grasp the outer jacket of the cable at the exiting end of the connector. A concentric, longitudinally offset inner bushing is inserted under the shielding (braid or foil) and mates with ridges on the inner surface of the half shells to form a tight, continuous radiation seal. A ferrite ring is inserted into a recess on the inner diameter of the inner bushing to provide noise suppression for signals traveling through the conductors of the cable. The inner and outer bushings are connected together with a fine web which maintains concentricity and axial displacement of the bushings before and during assembly, but which does not interfere with the operation of the connector after assembly.

10 Claims, 1 Drawing Sheet

SHIELDED CONNECTOR ASSEMBLY WITH NOISE SUPPRESSOR

TECHNICAL FIELD

This invention relates to electrical connector assemblies and, more particularly, to universal connector assemblies which provide continuous shielding for connectors used with shielded cables, and which provides noise suppression for all of the wires in the shielded cable.

BACKGROUND OF THE INVENTION

The increased use of miniaturized electronics for data processing, signal processing and electrical component control circuits has required a corresponding increase in the demand for the multi-conductor connectors needed to connect such electronic components together. In some applications, such as in high security areas, in areas particularly sensitive to electromagnetic radiation, and in areas where such radiation might be considered a health hazard, it is necessary to provide electromagnetic shielding for such equipment, for the cables interconnecting such equipment, and for the connectors terminating such cables.

Shielded connectors for multi-conductor cables are well-known. Such connectors must provide a surrounding shell which is conductive in order to shield the internal wires and a mechanism for completing a radiation-tight electrical connection between the metallic shell and the conductive braid or foil surrounding the wires of the cable. While such structures provide adequate shielding for most installations, some applications for extremely noisy signals, require further signal noise suppression.

It has been common in electromagnetically noisy environments to minimize the amount of noise that escapes from the enviroment by conduction through the electrical conductors leaving the environment. This can be accomplished by a capacitor to ground which filters out the high frequency components, or a ferrite ring surrounding the conductors in which eddy currents are induced and which thereby disburse the high frequency signal components. Miniature filters have likewise been used for this purpose. All of these noise suppression techniques take up space in the electronics cabinet, often on a printed wiring board (PWB), thereby increasing the bulk, weight and cost of the electronic equipment. Moreover, the noise suppressors are often unsightly and hence cannot be placed in plain view.

SUMMARY OF THE INVENTION

In accordance with the illustrative embodiment of the present invention, these and other problems are overcome by locating the noise suppressor inside of a connector assembly used to connect the noise-carrying signal wires to equipment outside the electronic cabinet. If the connector design includes a noise suppressor which is integral with and located on the inside of the connector, the noise suppressor will be out of sight, inexpensive to implement, and will be located outside of the electronics cabinet.

More particularly, some connector assemblies include a non-metallic bushing inserted between the metallic braid of a multiconductor cable and the outer jacket of the cable in order to force the braid into intimate electrical contact with the connector cover. In this way, the electromagnetic shielding provided by the braid is extended to the connector assembly. One such shielded connector assembly is shown in the copending application of the present applicant, Ser. No. 345,787, filed May 1, 1989. A ferrite ring is made integrally with the interior of such a bushing. When the bushing is inserted between the conductive braid and the bundle of conductors, the ferrite ring is simultaneously, and without further effort, inserted around the bundle of conductors, in close proximity thereto and electrically isolated from all conductive surfaces by the non-conductive bushing. Such a ferrite ring provides ideal noise suppression for high frequency noise signals traveling through the conductors.

The major advantages of the present invention over prior art noise suppression arrangements is the ease with which noise suppression can be accomplished, the fact that the noise suppressor is not contained within the electronic cabinet and that the noise suppressor is nevertheless out of sight. Moreover, a simple ferrite ring, or split ferrite ring, suitable for such noise suppression adds very little to the cost of the shielded connector and contributes virtually no added cost to the assembly operation.

BRIEF DESCRIPTION OF THE DRAWINGS

A complete understanding of the present invention may be gained by considering the following detailed description in conjunction with the accompanying drawing, in which.

To facilitate reader understanding, identical reference numerals are used to designate elements common to the figures.

DETAILED DESCRIPTION

Figure 1:
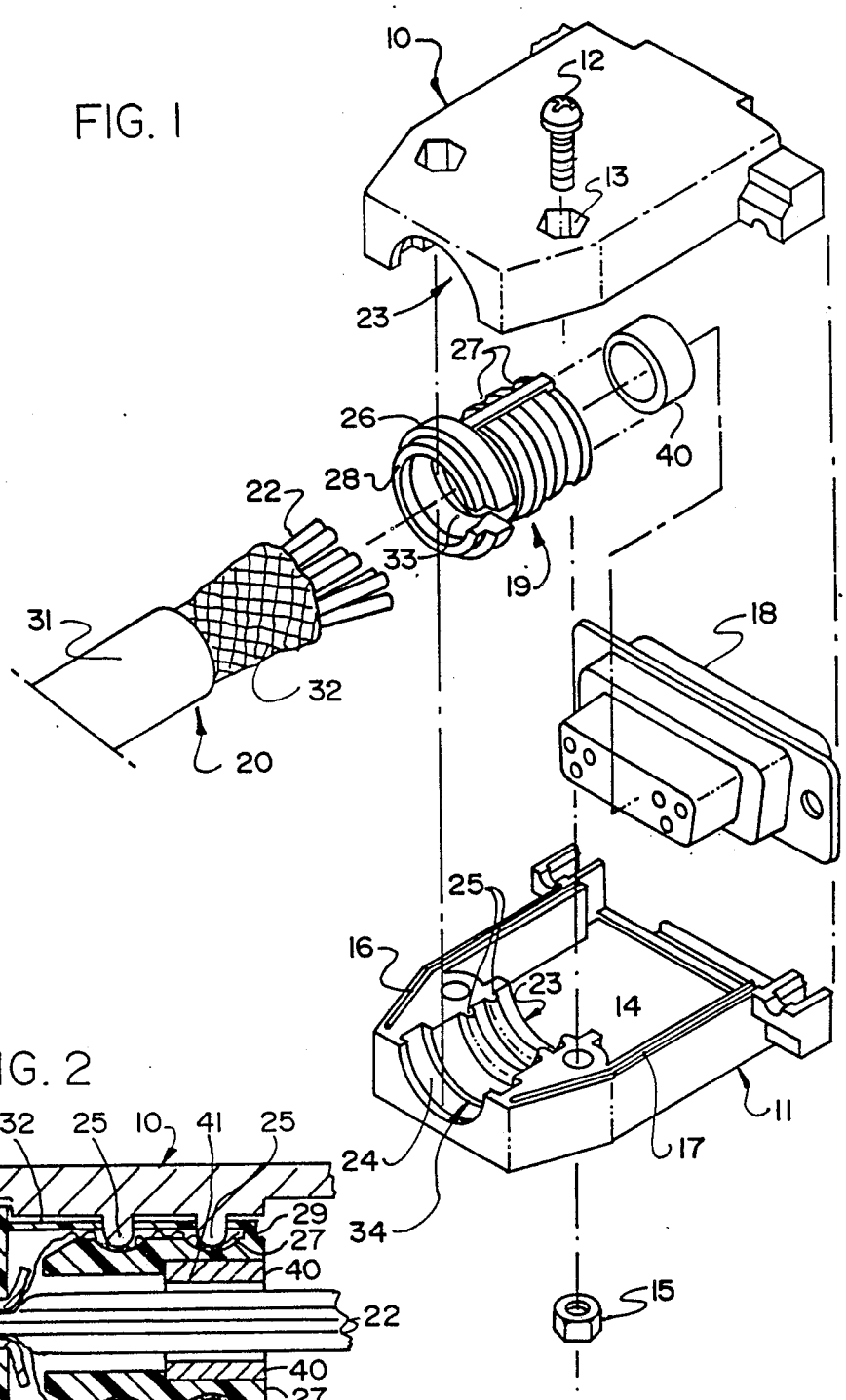
FIG. 1 shows a perspective, exploded view of a shielded connector assembly including a ferrite ring noise suppressor in accordance with the present invention.

Referring more particularly to FIG. 1, there is shown a perspective exploded view of a shielded connector assembly incorporating a ferrite ring noise suppressor in accordance with the present invention. The connector assembly of FIG. 1 comprises a first half shell member 10 and a second half shell member 11. The half shells 10 and 11 are designed to fit together as shown in the cross-sectional view of FIG. 2, to form a box-like enclosure. The half shell members 10 and 11 are maintained in a closed position by screws such as screw 12 inserted through hole 13 in half shell 10, through hole 14 in half shell 11, and fastened by nuts such as nut 15. Ridges 16 and 17 on the mating surface of lower half shell 11 fit snugly into matching grooves (not visible in FIG. 1) on the mating surface of upper half shell 10 to insure accurate registration when the half shells 10 and 11 are fastened together, and to provide a labyrinthine path for radiation leakage. In accordance with well-known connector technology, the half shells 10 and 11 can be fabricated by die casting metal or by molding plastic. If a plastic connector is to provide electromagnetic shielding, the plastic half shells must be coated with a conductive layer to provide the necessary shielding.

When closed, half shells 10 and 11 capture an electrical connector head 18 at one end thereof and capture a double bushing 19 and a shielded cable 20 at the opposite end thereof. In the course of assembly, the ends of wires 22 of cable 20 are connected to electrical contacts at the rear of connector head 18 to complete an electrical circuit from the wires 22 through the connector head 18 to equipment having a mating connector head, all in accordance with well-known connector technology. For convenience, the right hand end of the half shells 10 and 11 at which the connector head 18 is located will be called the head or front of the connector assembly of FIG. 1, and the opposite, left hand end will be called the tail or rear of the connector assembly. The construction of the head or front of the connector assembly of FIG. 1 can be done in accordance with well-known principles and forms no part of the present invention, and will not be further described here.

The rear or tail ends of the half shells 10 and 11 define a cylindrically shaped passage 23 having a transverse circumferential or peripheral groove 24 at the tail end thereof and having a plurality of transverse circumferential or peripheral ridges 25 near the head or front end thereof. Bushing 19 includes a ridge 26 which mates with the groove 24 and a plurality of grooves 27 which mate with the ridges 25 when the half shells 10 and 11 are brought together around bushing 19.

Figure 2:
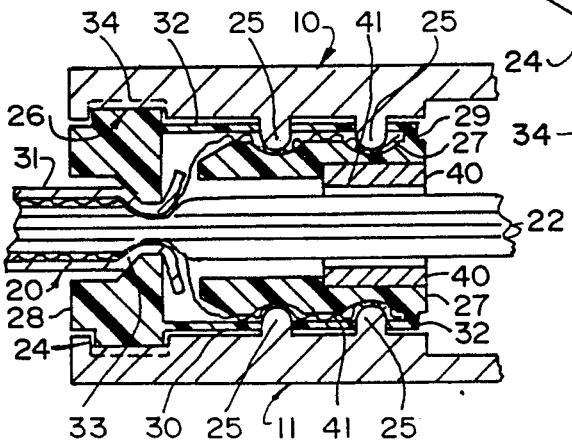
FIG. 2 is a longitudinal, cross-sectional view of a portion of the assembled connector shown in FIG. 1, showing details of the ferrite ring assembly in accordance with the present invention.

Bushing 19, shown in more detail in FIG. 2, is actually two separate bushings 28 and 29, held in a coaxial but longitudinally offset relationship by a pair of thin web members 30 at diametrically opposite sides of the double bushing 19. The rear outer bushing 28 has an inner diameter sufficiently large to fit easily over the outer jacket 31 of cable 20. Bushing 28 may be split at one point in its circumference to fabilitate slipping it over jacket 31. The outer surface of bushing 28 includes the circumferential ridge 26 which mates with the groove 24 in the half shells 10 and 11. A ferrite ring 40 is inserted into a recess 41 (see FIG. 2) in the inner diameter of inner bushing 29. Ring 40 is snugly press-fit into bushing 29 and is held in position in bushing 29 by sufficient friction to permit shipping and handling of bushing 29 without dislodging ring 40.

The firrite ring 40 in inner bushing 29 has an inner diameter sufficiently large to fit over the bundle of wires 22 in cable 20, but not sufficiently large to fit over a braided metallic shielding 32 enclosing the wires 22. The ferrite ring 40 is therefore in the best possible position to provide suppression of high frequency noise signals traveling along the conductors of bundle 22. Such noise signals induce electrical currents in the body of ferrite ring 40 which currents are rapidly dissipated as heat due to the significant resistance to the flow of electric current offered by the ferrite material. The amount of attenuation afforded by ferrite ring 40 is proportional to the axial length of ring 40 and hence can be adjusted to suppress noise without significantly affecting desired signals.

The outer surface of inner bushing 29 has circumferential grooves 27 which mate with the ridges 25 in half shells 10 and 11. As can best be seen in FIG. 2, the rear end of inner bushing 29 is beveled so that inner bushing 29, when pushed over the bundle of wires 22, tends to slip under the braided layer 32.

The completed connector assembly of the present invention is assembled as follows: The ferrite ring 40 is assembled to the bushing 19 by press fitting the ring 40 into the recess 41 (better seen in FIG. 2). The half-shells 10 and 11, the bushing 19, the connector head 18 and the nuts and bolts are supplied as a connector assembly kit in various sizes to accommodate cables of various diameters. To assemble the connector to the cable, first the outer jacket 31 of the cable 20 is stripped back from the ends of wires 22 by a distance approximately the length of the connector housing. The braided shielding 32 is, in turn, stripped back from the ends of wires 22 to a distance from the jacket approximately equal to the length of the double bushing 19. The individual wires 22 are then stripped and attached to to electrical contacts at the rear face of the connector head 18. The length to which the jacket 31 and the braiding 32 are stripped back is not critical, so long as the wires 22 reach the connector head 18. Any reasonable excess length of wires 22 or braiding 32 can be accommodated within the cavity behind connector head 18 and in front of hole 23.

Next, the double bushing 19 is inserted over the wires 22. The leading edge of the inner bushing 29 pushes the braided shielding 32 back on the wires 22. As the braiding 32 is pushed back, it tends to expand in diameter until the beveled leading edge of inner bushing 29 slips under the braiding. The double bushing 19 continues to be pushed in until the nose or leading edge of the inner bushing 29 rests against the edge of the jacket 31 of cable 20. The ferrite ring 40, attached to the inner bushing 29, likewise slides over the bundle 22 of electrical wires. Due to the insulating properties of bushing 29, ferrite ring 40 is not permitted to contact any conducting surface in the interior of the connector assembly.

At this point, the outer bushing 28 of double bushing 19 is located over the end of the jacket 31. Outer bushing 28 may be sprung open somewhat to facilitate its passage over the end of jacket 31, thus taking advantage of the split in the outer bushing 28. The double bushing will tend to stay in place during the balance of the assembly of the connector in a manner similar to the "Chinese Finger Lock." That is, any attempt to pull the bushing 29 out from under the braiding 32 causes the braiding to shrink in diameter and grasp the bushing 29 more firmly. At this time, the individual wires 22 can be connected to the rear of the connector head 18 in accordance with well-known and standard practices.

Once the connector head 18 is attached to the wires 22, the two half shells 10 and 20 can be assembled over the cable and connecotr head assembly, using screws such a screw 12. The webs 30 are oriented directly towards the half shells 10 and 11, and away from the vicinity of the mating surfaces. This prevents the webs 30 from becoming pinched between the half shells 10 and 11 and thus preventing full closure of the half shells. The ridge 26 must be mated with the groove 24 and the grooves 27 mated with the ridges 25. At the same time, the connector head 18 must be mated with the front end of the half shells 10 and 11. Any reasonable excess of wires 22 or of braiding 32 extending beyond the trailing edge of inner bushing 19 can be looped or accordion pleated between head 18 and bushing 19 simply by pushing head 18 toward bushing 19. The cavity forming by the half shells 10 and 11 will readily accommodate such loops or accordion pleats.

When the half shells 10 and 11 are closed by screws 12, the ridge 26 on outer bushing 28 is locked into the groove 24 to securely fasten the bushing to the half shells. At the same time, a ridge or buttress 33 on the inner diameter of outer bushing 28 engages and pinches the outer jacket 32 of cable 20 to provide strain relief. That is, any forces exerted on the cable 20 are transferred to the connector housing formed by half shells 10 and 11 rather than to the electrical connections at the rear of connector head 18. This prevents the electrical connections from being damaged by such forces.

As is better shown in FIG. 2, the braided shielding 32 is captured between the outer surface of inner bushing 29 and the inner surface of the hole 23 in the area of ridges 25 while the ferrite ring 40 is held in close proximity to the internal bundle of wires 22. As the half shells 10 and 20 are closed, the conductive inner surface of the half shells are brought into intimate electrical contact with the metallic braiding 32. This intimate contact provides an essentially continuous electrical contact which insures a continuous electromagnetic shield. The thin webs 30 become deformed by the mating grooves and ridges and enmeshed in the conductive braiding.

In accordance with the preferred embodiment of the present invention, the ferrite ring 40 is made of some such material such as Number 63 ferrite compound from the Stackpole Company. Ring 40 may be continuous or may be split, but must be electrically floating to prevent the eddy currents from being carried away without dispersion. The half shells 10 and 11 may be made of a high impact plastic such as polystyrene or ABS with a conductive coating. The double bushing 19 is made of a slightly flexible material such as polyvinylchloride (PVC) with a rigidity of 80 to 90 durometers. The half shells could, of course, also be die cast metal.

Referring to FIG. 2, there is shown a cross-sectional view of the fully assembled connector illustrated in exploded view in FIG. 1. Identical elements are identified with the same reference numerals. Only the rear or tail end of the connector assembly is shown in FIG. 2 since the head or connection end is constructed in accordance with the known technology and forms no part of the present invention. As best seen in FIG. 2, the surface of groove 24 can include a plurality of triangular longitudinal ridges 34 which assist in providing torsional strain relief. The pointed tops of these longitudinal ridges 34 depress and engage the outer surface of the outer bushing 28 to "grasp" the bushing and prevent rotational movement within the connector shell.

As also can be best seen in FIG. 2, the radius of curvature of the grooves 27 is substantially greater than the radius of curvature of the ridges 25, thus providing significant open space in the vicinity of their closure. This space is therefore advantageously available to take up unevenesses and variations in the weave of the braiding 32, and to accommodate any misregistration of the ridges 25 to the grooves 27, thereby facilitating continuous intimate closure of ridges 25 on the braiding 32.

As can be seen in FIG. 2, ferrite ring 40 surrounds wire bundle 22 and therefore is able to suppress large amplitudes of high frequency noise signals traveling along the wires of bundle 22. This noise suppression function is accomplished with very little increase in the cost or complexity of the connector. Furthermore the noise suppressor is out of sight and is outside of any electronic cabinet where space is at a premium.

Although the noise suppressor of the present invention has been disclosed in connection with the double bushing shielded connector of applicant's aforementioned copending application, it is clear that a ferrite ring with an insulated outer surface can be inserted between the cable sheath and the outer braid of any shielded cable and provide noise suppression without otherwise affecting the operation of the cable.

It should also be clear to those skilled in the art that further embodiments of the present invention may be made by those skilled in the art without departing from the teachings of the present invention.

What is claimed is:

1. A noise suppression system for electronic equipment, comprising
   an electrical cable with an outer sheath surrounded by a conductive shielding, and
   a ferrite cylinder having an insulated outer surface,
   said ferrite cylinder being inserted between said outer sheath and said conductive shielding.

2. The noise suppression system according to claim 1 wherein
   said ferrite cylinder is split longitudinally to simplify insertion over said sheath.

3. The noise suppression system according to claim 1 further comprising
   an electrical connector encapsulating said ferrite cylinder and providing electrical connections for the wires of said cable.

4. The noise suppression system according to claim 3 further comprising
   means, including said insulated ferrite cylinder, for urging said conductive shielding against the inner surface of said connector.

5. The noise suppression system according to claim 3 further comprising
   means, not including said insulated ferrite cylinder, for providing strain relief for said connector.

6. A noise suppression system for electronic equipment comprising
   a cable for carrying electrical signals to and from said electronic equipment, said cable including an outer insulative sheath surrounded by a conductive braid,
   a connector for connecting said cable to said electronic equipment, said connector including a bushing for insertion between said braid and said outer sheath, and
   a ferrite noise suppressor located on the inner diameter of said bushing.

7. The noise suppression system according to claim 6 wherein
   said ferrite noise suppressor comprises a solid ferrite ring.

8. The noise suppression system according to claim 6 wherein
   said ferrite noise suppressor comprises a split ferrite ring.

9. The noise suppression system according to claim 6 further comprising
   means for capturing said braid between the outer diameter of said bushing and the interior of said connector to complete an electromagnetic shield including said braid and said connector.

10. The noise suppression system according to claim 6 further comprising.
   means for providing strain relief for said connector at a point on said said cable substantially displaced from said ferrite noise suppressor.

* * * * *